US009558727B2

(12) United States Patent
Chu

(10) Patent No.: US 9,558,727 B2
(45) Date of Patent: Jan. 31, 2017

(54) PERFORMANCE METHOD OF ELECTRONIC MUSICAL INSTRUMENT AND MUSIC

(71) Applicant: Shaojun Chu, Urumuqi (CN)

(72) Inventor: Shaojun Chu, Urumuqi (CN)

( * ) Notice: Subject to any disclaimer, the term of this patent is extended or adjusted under 35 U.S.C. 154(b) by 0 days.

(21) Appl. No.: 14/781,036

(22) PCT Filed: Apr. 4, 2014

(86) PCT No.: PCT/CN2014/000370
§ 371 (c)(1),
(2) Date: Sep. 29, 2015

(87) PCT Pub. No.: WO2014/169700
PCT Pub. Date: Oct. 23, 2014

(65) Prior Publication Data

US 2016/0063975 A1 Mar. 3, 2016

(30) Foreign Application Priority Data

Apr. 16, 2013 (CN) ..... 2013 1 0132367

(51) Int. Cl.
*G10H 1/36* (2006.01)
*G10H 7/00* (2006.01)
*G10H 1/00* (2006.01)

(52) U.S. Cl.
CPC ..... *G10H 1/0066* (2013.01); *G10H 1/0033* (2013.01); *G10H 2210/105* (2013.01);
(Continued)

(58) Field of Classification Search
CPC ..... G10H 1/0066; G10H 1/0033; G10H 2210/105;G10H 2240/285; G10H 2240/311; G10H 2240/321; G10H 2240/056; G10H 1/00; G09B 15/023; G09B 15/002; G10G 1/00
(Continued)

(56) References Cited

U.S. PATENT DOCUMENTS 6,483,019 B1 * 11/2002 Hamilton ..... G09B 15/023 84/477 R
7,119,266 B1 * 10/2006 Bittner ..... G09B 15/023 84/477 R
(Continued)

FOREIGN PATENT DOCUMENTS

CN 87209253 U 7/1988
CN 87104074 A 12/1988
(Continued)

*Primary Examiner* — Jeffrey Donels
(74) *Attorney, Agent, or Firm* — Gokalp Bayramoglu

(57) ABSTRACT

An electronic music instrument and music performance method mainly comprises the following steps: a, selecting a music score to be played in an electronic music score management unit, and selecting a played voice part and/or an automatic accompaniment voice part, the type of a music instrument, a corresponding input device, a performance music instrument, an output device and a reference voice part; b, starting an electronic music instrument performance device for playing said music score, transmitting a performance control signal to a digital music instrument unit under the control of a performance control unit to enable the digital music instrument unit to carry out corresponding performance actions or transmitting the performance control signal to a signal output unit.

19 Claims, 2 Drawing Sheets

(52) U.S. Cl.
CPC . *G10H 2240/056* (2013.01); *G10H 2240/285* (2013.01); *G10H 2240/311* (2013.01); *G10H 2240/321* (2013.01)

(58) Field of Classification Search
USPC ..... 84/634
See application file for complete search history.

(56) References Cited

U.S. PATENT DOCUMENTS

2003/0094093 A1* 5/2003 Smith ..... G10H 1/0058 84/609
2003/0167903 A1* 9/2003 Funaki ..... G09B 15/003 84/477 R
2006/0117935 A1* 6/2006 Sitrick ..... G09B 15/023 84/477 R
2006/0150803 A1* 7/2006 Taub ..... G09B 15/023 84/616
2006/0254407 A1* 11/2006 Jarrett ..... G10H 1/0008 84/601
2007/0227336 A1* 10/2007 Fukada ..... G10H 1/0008 84/600
2008/0002549 A1* 1/2008 Copperwhite ..... G10G 1/00 369/83
2008/0196575 A1* 8/2008 Good ..... G09B 15/04 84/470 R
2008/0302233 A1* 12/2008 Ding ..... G09B 15/002 84/609
2009/0064851 A1* 3/2009 Morris ..... G10H 1/0025 84/637
2011/0203442 A1* 8/2011 Raveendran ..... G10G 1/00 84/483.1
2012/0227571 A1* 9/2012 Sasaki ..... G10G 1/00 84/477 R
2013/0319209 A1* 12/2013 Good ..... G09B 15/04 84/483.2
2014/0283668 A1* 9/2014 Soejima ..... G09B 15/002 84/477 R
2015/0059558 A1* 3/2015 Morell ..... G10H 1/0025 84/609

FOREIGN PATENT DOCUMENTS

CN 1379898 A 11/2002
CN 1828719 A 9/2006
CN 101123084 A 2/2008
CN 101278334 A 10/2008
CN 102592485 A 7/2012
CN 103258529 A 8/2013
JP 2003271140 A 9/2003

* cited by examiner

PERFORMANCE METHOD OF ELECTRONIC MUSICAL INSTRUMENT AND MUSIC

TECHNICAL FIELD

The present invention relates to the technical field of electronic music instrument and music performance, as well as electronic music score information processing, and particularly relates to an electronic music instrument and music performance method.

BACKGROUND ART

For the music instrument performance, music sound at an appropriate music pitch is produced by controlling keys, chords, breaths, etc., and the performance of a musical composition is completed by controlling rhythms, force, timbre, etc. For many music instruments, a lot of practice is needed to master relevant skills for completing the musical composition performance.

At present, similar products are software such as Magic Zither, Guqin, Magic Piano and the like running on iPhones and iPads. Said software can control a system to produce music sound to realize the musical composition performance by virtue of click and slide actions on a touch screen according to a track selected from a music library. The software has functions for controlling the force as well as timbre such as portamento, vibrato, etc. This product can play the correct sound according to the music score without controlling the music pitch (selecting a music instrument chord corresponding to a music score note). However, the product is not based on the electronic music instrument and does not play the music according to the music score; multiple voice parts cannot be independently and simultaneously played; the ensemble of multiple persons and multiple music instruments is not supported; the automatic performance of a non-played voice part is not supported; the input of an external action signal is not supported; the connection to external digital and electronic music instruments (adopting an MIDI (Musical instrument Digital Interface) specification) is not supported.

For example, in the patent of Human-Machine Cooperated Music Performance Instrument System (application No. B7104074, invalid now and the patent of Super-Human-Machine Cooperated Music Program-controlled Instrument (application No. 87209253, invalid now), the correct sound can be played according to the music score without controlling the music pitch (selecting a music key corresponding to the music score note). However, by adopting the performance way that the instrument does not produce sound with instruction if a control key is not pressed, the music instrument cannot produce the sound either when the control key is pressed but no instruction is provided, and the music instrument only can produce the sound when the instruction is provided and the control key is pressed, multiple voice parts cannot be independently and simultaneously played, multiple music instrument ensemble is not supported; the automatic performance of the non-played voice part is not supported; a single note in a group of notes cannot be played and controlled; the input of the external action signal is not supported; the connection to external digital and electronic music instruments (adopting the MIDI specification) is not supported.

There are some other technologies and products for controlling the music play by utilizing the actions, for example, the patent of a method for controlling the note play by virtue of variation of action directions (application No. 201110442230.X. application date: Dec. 26, 2011), the patent of method and device for playing the music instrument on basis of a digital music file (application No. 00814372.2) and the patent of a trigger playback device for controlling music or sound in real time by an actor and a method (application No. 200610110665.0) are characterized in that the music playing speed (rhymes), volume (force), etc. of a music playing device are controlled by virtue of actions rather than the control on the music instrument performance so as to control the music performance, so that a single voice part and a single note cannot be played and controlled, and the effect for playing the music instrument cannot be realized.

Therefore, in the prior art, while the music instrument and music performance is simplified, the music instrument performance cannot be comprehensively and accurately controlled, so that the music performance experience and effect are greatly different from those of the real music instrument performance.

SUMMARY

The present invention innovatively integrates the characteristics of the electronic music instruments, especially the digital music instrument and the electronic music score, and discloses an electronic music instrument and music performance method, and on the premise of meeting the requirements of the music instrument and music performance, the condition that the performance can be played simply and conveniently according to the music score is realized.

In order to achieve said purpose, the present invention adopts the following technical scheme: an electronic music instrument and music performance method, mainly comprising:

a, selecting a music score to be played in an electronic music score management unit; b, selecting one of more voice parts (at least one playing voice part) played by an operator and an automatically-played voice part in a performance control unit; selecting an operation control input device and/or action and performance music instrument corresponding to the playing the voice part; selecting to output to a digital music instrument unit and/or signal output unit; selecting a reference voice part; starting the performance, then operating the input device by a player to generate an operation signal, transmitting a performance control signal to the digital music instrument unit under the control of the performance control unit to carry out the corresponding performance actions or transmitting the performance control signal to the signal output unit.

further, in the step b, transmitting the performance control signal to the digital music instrument unit under the control of the performance control unit to enable the digital music instrument unit to carry out the corresponding performance actions, or transmitting the performance control signal to the signal output unit, to be specific, b1, receiving the operation signal inputted by the control input device by virtue of an action capturing unit, and converting the operation signal to a music instrument performance action signal, wherein the action capturing unit can simultaneously operate multiple and various operation control input devices to play the music instrument and the music; different operation actions of one device correspond to different open scores; b2, generating a performance control signal by virtue of the performance control unit according to the music score information on the basis of the music instrument performance action signal acquired by the action capturing unit; b3, detecting the playing speed of the reference open score based on a control signal generating result, and controlling the automatic performance of the automatically-played voice part according to the reference playing speed, wherein the operations for controlling the automatically-played voice part according to the obtained reference playing speed specifically comprise: determining a playing point in time of each performance note or each group of performance notes of each automatically-played voice part according to the reference playing speed (i.e. music rhythm); extracting corresponding performance information from the music score at each time of and after the performance time of each reference voice part and when the playing point in time of the automatically-played voice part is reached to form a performance control signal; b4, transmitting the performance control information to the digital music instrument unit to carry out the performance, or transmitting to the signal output unit to control a third-party electronic and digital music instrument to carry out the performance.

Further, the electronic music instrument management unit, comprising:

a music score input module which is used by a user to input a music score data file; a music score storage module which is used for storing the music score data file inputted from the music score input module to form a user music library provided for the performance control unit to call.

Further, the input device comprises one or more of a computer keyboard, a touch screen, a camera and a communication interface connected with external devices, which are respectively connected to the electronic music instrument performance device;

the input device also comprises a communication interface connected with the input device, wherein said communication interface comprises an MIDI and/or a Bluetooth interface and/or a USB (Universal Serial Bus) interface.

Further, the output device comprises an audio device which is connected with the digital music instrument unit and used for receiving an audio signal outputted by the digital music instrument unit as well as one of more of an electronic music instrument, a digital music instrument, a local digital music instrument and a synthesizer, which are respectively connected with the signal output unit and used for receiving the performance signal outputted by the signal output unit.

Further, the performance control unit comprises:

a music score information extraction module which is used for extracting one note or a group of notes which are at the closest point in time and are not played from the performance open score corresponding to the input device and action as well as relevant performance information; a second signal generating module which is used for generating the performance information acquired by a first signal conversion module and the current music score performance information extracted by the music score information extraction module into a complete music instrument performance control signal and outputting the complete music instrument performance control signal respectively to the digital music instrument unit and/or signal output unit; a performance rhythm detection module which is used for detecting the reference open score playing speed, used as the reference playing speed or rhythm, on the basis of the music instrument performance control signal; an automatic performance unit which is used for controlling the performance of the automatically-played voice part according to the reference playing speed so as to realize the automatic accompaniment and ensemble. Further, the electronic music instrument performance device comprises an action capturing unit and a performance control unit, which are sequentially connected with the operation control input device as well as an electronic music score management unit, a digital music instrument unit and a signal output unit, which are respectively connected with the performance control unit; the digital music instrument unit and the signal output unit are respectively connected to the output device.

Further, the action capturing unit comprises:

a signal receiving module which is used for receiving an operation signal generated by the operation control input device; a first signal conversion module which is used for converting the operation signal received by the signal receiving module to performance information at least including an operation number as well as possible performance actions such as force, timbre, music pitch, aftertouch, etc. according to different input devices.

The present invention also adopts another technical scheme: an electronic music instrument and music performance system for realizing the electronic music instrument and music performance method mainly comprises an operation control input device for inputting the operation signal, an electronic music instrument performance control device with electronic music instrument performance software and capable of processing the operation signal inputted by the operation control input device and an output device for outputting the signal processed by the electronic music instrument performance device.

Further, the operation control input device comprises one or more of a computer keyboard, a touch screen, a camera and a communication interface connected with external devices, which are respectively connected to the electronic music instrument performance device.

Further, the communication interface comprises an MIDI and/or a Bluetooth interface and/or a USB interface.

Further, the electronic music instrument performance device comprises an action capturing unit and a performance control unit, which are sequentially connected with the operation control input device as well as the electronic music score management unit, the digital music instrument unit and the signal output unit, which are respectively connected with the performance control unit; the digital music instrument unit and the signal output unit are respectively connected to the output device; the electronic music instrument performance software is embedded into the performance control unit.

Further, the action capturing unit comprises:

a signal receiving module which is used for receiving the operation signal generated by the operation control input device; a first signal conversion module which is used for converting the operation signal received by the signal receiving module to performance information at least including an operation number as well as possible performance actions such as force, timbre, music pitch, etc.

Further, the performance control unit comprises:

a music information extraction module which is used for extracting one note or a group of notes which are at the closest point in time and not played from the performance open score corresponding to the input device and action as well as relevant performance information; a second signal generating module which is used for generating the performance information acquired by a first signal conversion module and the current music score performance information extracted by the music score information extraction module into a complete music instrument performance control signal and outputting the complete music instrument performance control signal respectively to the digital music instrument unit and/or signal output unit; a performance rhythm detection module which is used for detecting the reference open score playing speed, used as reference playing speed or rhythm, on the basis of the music instrument performance control signal; an automatic performance unit which is used for controlling the automatic performance of the non-played voice part according to the reference performance speed so as to realize the automatic accompaniment and ensemble.

Further, the electronic music instrument management unit comprises:

a music score input module which is used by a user to input music score data file; a music score storage module which is used for storing the music score data file inputted from the music score input module to form a user music library provided for the performance control unit to call.

Further, the output device comprises an audio device which is connected with the digital music instrument unit and used for receiving an audio signal outputted by the digital music instrument unit as well as one or more of an electronic music instrument, a digital music instrument, a local digital music instrument and a synthesizer, which are respectively connected with the signal output unit and used for receiving the performance signal outputted by the signal output unit.

The electronic music instrument and music performance method of each embodiment of the present invention mainly comprises the steps of selecting the music score to be played in the electronic music score management unit, and selecting the to be-played voice part, the music instrument type, the corresponding input device, the performance music instrument, the output device and the reference voice part; starting the electronic music instrument performance device for playing the music score, transmitting the performance control signal to the digital music instrument unit under the control of the performance control unit to carry out the corresponding performance actions or transmitting the performance control signal to the signal output unit; playing each voice part of the music score in a combination way by adopting independent input devices or actions. Multiple and various input devices can be simultaneously utilized by one or more persons to perform a score including different music instruments and a plurality of voice parts, and the actions of the operator (player) and the music score information can be generated into a complete music instrument performance action; the control action for operating the music instrument can be simplified, and the music instrument and music performance can be simplified.

The electronic music instruments stated in the present invention include hardware devices such as the electronic music instrument, digital music instrument, music synthesizer and the like, which are provided with performance control signal interfaces and also include relevant music instruments in a software form; the digital music score is a music digital file and digital data shown in a given data structure, for example, midi format music score, Overture format music score and other data files and data.

Other characteristics and advantages of the present invention are illustrated in the subsequent specifications; moreover, partial characteristics and advantages are obvious from the specifications or are known by implementing the present invention.

The technical scheme is further described in details by virtue of attached drawings and embodiments.

BRIEF DESCRIPTION OF THE DRAWINGS

The attached figures are used for providing further comprehension of the present invention and constitute one part of the specifications. The attached figures are used for interpreting the present invention together with the embodiments of the present invention but not limit the present invention. In the attached figures.

DETAILED DESCRIPTION

The preferable embodiments of the present invention are illustrated according to the attached drawings, and it shall understand that the preferable embodiments are only used for illustrating and interpreting the present invention but not for limiting the present invention.

Figure 1:
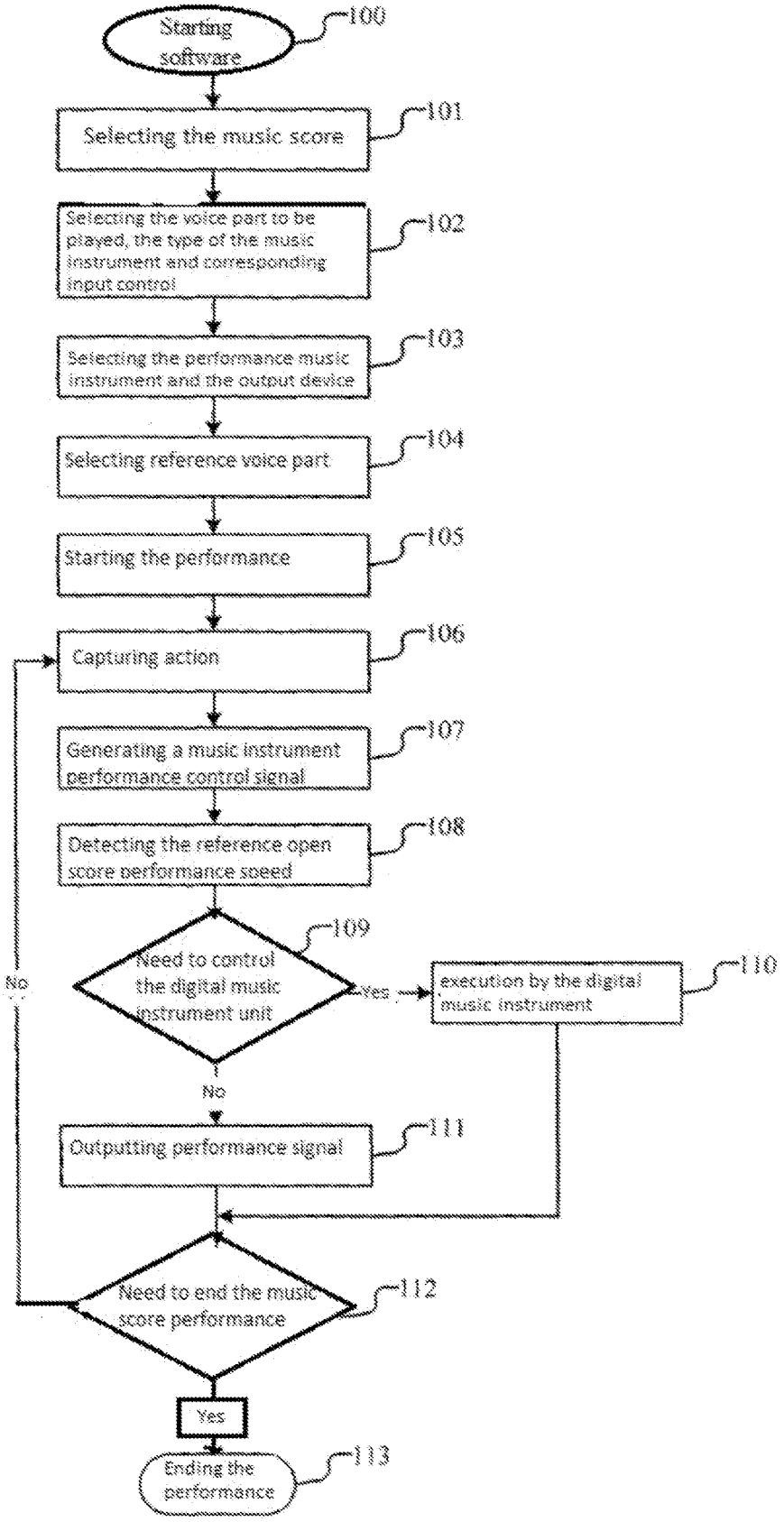
FIG. 1 is a workflow schematic diagram of the electronic music instrument and music performance method.

Refer to the FIG. 1, the workflow of the electronic musical instrument and music performance method of the embodiment comprises the following steps:

step 100: starting electronic musical performance software embedded in the electronic musical instrument and music performance system, and entering the step 101;

step 101: selecting the music score to be played, and entering the step 102;

step 102: selecting the played voice part, musical instrument types and corresponding input control (input device), and entering the step 103;

step 103: selecting the performance musical instrument and the output device, and entering the step 104;

step 104: selecting the reference voice part, and entering the step 105;

step 105: starting the electronic musical instrument performance device, and entering the step 106;

step 106: capturing actions, and entering the step 107;

step 107: generating the musical instrument performance control signal and entering the step 108;

step 108: detecting the reference open score playing speed, and entering the step 109;

step 109: judging whether the digital music instrument unit needs to be controlled or not, entering the step 110 if the digital music instrument unit needs to be controlled, otherwise, entering the step 111;

step 110: enabling the digital music instrument unit to carry out, and entering the step 112;

step 111: outputting the performance signal, and entering the step 112;

step 112: judging whether the music score performance needs to be ended or not, entering the step 113 if the music score performance needs to be ended; otherwise, entering the step 106;

step 113: ending the current performance.

In the electronic musical instrument and music performance method shown in the steps 100-113, the electronic music score management unit comprises the music input module which is used by the user to input the music score data file; the music score storage module which is used for storing the music score data file inputted by the music score input module to form the user music library provided for the performance control unit to call. The input device comprises one or more of the computer keyboard, the touch screen, the camera and a communication interface connected with external devices, which are respectively connected to the electronic music instrument performance device; the input device also comprises the communication interface which is connected with the input device, wherein the communication interface includes the MIDI and/or the Bluetooth interface and/or the USB interface. The output device comprises an audio device which is connected with the digital music instrument unit and used for receiving an audio signal outputted by the digital music instrument unit as well as one or more of an electronic music instrument, a digital music instrument, a local digital music instrument and a synthesizer, which are respectively connected with the signal output unit and used for receiving the performance signal outputted by the signal output unit.

In the electronic musical instrument and music performance method shown in the steps 100-113, the performance control unit comprises the music score information extraction module which is used for extracting a note or a group of notes which are at the closest point in time from the performance open score corresponding to the input device and action as well as relevant performance information; the second signal generation module which is used for generating the performance information acquired by the first signal conversion module and the current music score performance information extracted by the music score information extraction module into the complete music instrument performance control signal and respectively outputting to the digital musical instrument unit and/or the signal output unit; the performance rhythm detection module which is used for detecting the reference open score playing speed which is used as the reference playing speed or rhythm on the basis of the music instrument performance control signal; the automatic performance unit which is used for controlling the automatic performance of the non-played voice parts according to the reference playing speed so as to realize the automatic accompaniment and ensemble. The electronic music instrument performance device comprises an action capturing unit and a performance control unit, which are sequentially connected with the operation control input device as well as the electronic music score management unit, the digital music instrument unit and the signal output unit, which are respectively connected with the performance control unit; the digital music instrument unit and the signal output unit are respectively connected to the output device. The action capturing unit comprises the signal receiving module which is used for receiving the operation signal inputted by the operation control input device, the first signal conversion module which is used for converting the operation signal received by the signal receiving module to performance information at least including the operation number as well as possible performance actions of force, timbre and pitch. In the specific implementation, in the electronic music instrument and music performance method shown in the steps 100-113, for example, the computer keyboard can be used as the input device, main time of a piano composition can be played by a single hand, and the accompanying tune can be automatically played by the system, so that complete musical composition performance can be realized; two voice parts can be respectively played by two hands. The keyboard keys can only provide the rhythm control information, and other information is supplemented by the information in the music score. For another example, the MIDI keyboard can be connected to the PC (Personal Computer), and the control information such as performance time (speed), force, timbre and the like of the MIDI keyboard is extracted when in performance and combined with performance notes in the music score to generate complete performance information. For another example, a wavetable synthesizer (belonging to the field of digital music instrument) that comes with the windows system can be used as the output device and the output device also can be connected to the digital music instrument software (such as a famous PIANOTEQ digital music instrument) of the local machine or other digital and electronic music instrument devices by virtue of the MIDI connection wire. In addition, the product has a lot of scenes in the future, and particularly, the input way adopting the touch screen is of great value.

According to the electronic music instrument and music performance method of the embodiment, each voice part of the music score is played by adopting independent input devices or actions in a combination way, and the score including different music instruments and a plurality of voice parts can be played by one or more persons through multiple and various input devices.

In real performance, the music score to be played shall be firstly selected by the operator, and then the corresponding relation among the input device, action, performance voice part and music instrument is determined. At least one voice part in the score can be selected to be played, and other voice parts are not played or automatically played. After the performance is started, the electronic music instrument and music performance system wait for the input actions of the user operation control device. After each or each group of operation actions is received, one closest and non-played note or one group of closest and non-played notes as well as relevant performance information are extracted from the corresponding voice part by virtue of the electronic music instrument and music performance system; after the note or the performance information is combined with the performance information contained in the input actions, a complete performance control signal is generated and then is immediately outputted to the connected music instrument to realize the performance; for all voice parts to be played, the above process is completed independently until the music score is ended. The non-played open score and voice part can be automatically played by the system according to the real performance rhythm.

The simplification of the performance lies in that the performer has no need to care whether the correct note and pitch are played but only controls the operation actions of the music instrument performance such as rhythm (speed), force, timbre and the like.

Figure 2:
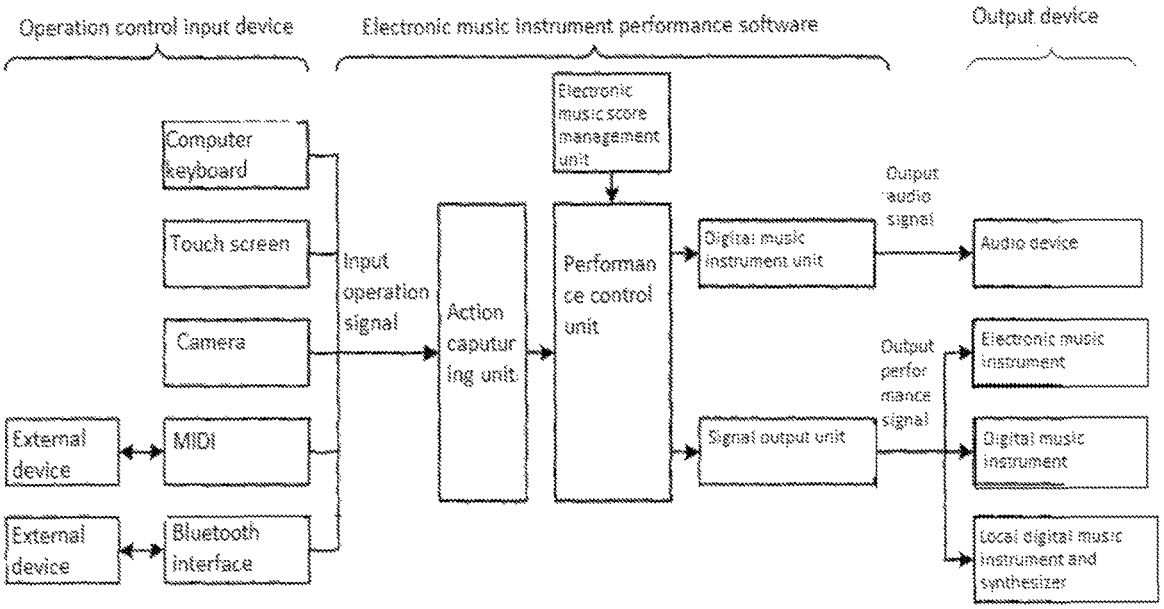
FIG. 2 is a working principle schematic diagram of the electronic music instrument and music performance system for realizing the electronic music instrument and music performance method.

In the embodiment of the present invention, as shown in FIG. 2, an electronic music instrument and music performance system for realizing the electronic music instrument and music performance method is provided, and the performance of the music instrument can be controlled according to the actions.

The electronic music instrument and music performance system mainly comprises the operation control input device for inputting the operation signal, the electronic music instrument performance device with electronic music instrument performance software and capable of processing the operation signal inputted by the operation control input device and the output device for outputting the signal processed by the electronic music instrument performance device.

The operation control input device comprises one or more of a computer keyboard, a touch screen, a camera and a communication interface connected with external devices. which are respectively connected to the electronic music instrument performance device. The communication interface comprises an MIDI, a Bluetooth interface and/or a UM interface.

The electronic music instrument performance device comprises an action capturing unit and a performance control unit, which are sequentially connected with the operation control input device as well as the electronic music score management unit, the digital music instrument unit and the signal output unit, which are respectively connected with the performance control unit; the digital music instrument unit and the signal output unit are respectively connected to the output device; the electronic music instrument performance software is embedded into the performance control unit.

The action capturing unit can comprise the signal receiving module which is used for receiving the operation signal inputted by the operation control input device; the first signal conversion module which is used for converting the operation signal received by the signal receiving module to performance information at least including performance actions of rhythm and/or force and timbre. The performance control unit can comprise the music score information extraction module which is used for extracting a note or a group of notes which are at the closest point in time and are not played from the performance open score corresponding to the input device and action as well as relevant performance information; the second signal generation module which is used for generating the performance information acquired by the first signal conversion module and the current music score performance information extracted by the music score information extraction module into the complete music instrument performance control signal and respectively outputting to the digital musical instrument unit and/or the signal output unit; the performance rhythm detection module which is used for detecting the reference open score playing speed which is used as the reference playing speed or rhythm on the basis of the music instrument performance control signal; the automatic performance unit which is used for controlling the automatic performance of the non-played voice parts according to the reference playing speed so as to realize the automatic accompaniment and ensemble. The electronic music score management unit can comprise the music input module which is used by the user to input the music score data file; the music score storage module which is used for storing the music score data file inputted by the music score input module to form the user music library provided for the performance control unit to call.

The output device comprises an audio device which is connected with the digital music instrument unit and used for receiving an audio signal outputted by the digital music instrument unit as well as one or more of an electronic music instrument, a digital music instrument, a local digital music instrument and a synthesizer, which are respectively connected with the signal output unit and used for receiving the performance signal outputted by the signal output unit.

With reference to FIG. 2, the electronic music instrument and music performance system for realizing the electronic music instrument and music performance method shown in the FIG. 1 mainly comprises the electronic music score management unit, the action capturing unit, the performance control unit, the digital music instrument unit and the signal output unit.

Specifically as follows:

(1) the electronic music instrument management unit: the electronic music instrument management unit can be used for realizing the inputting and storing of the music instrument data file to form a user music library. The electronic music instrument and music performance system not only supports the electronic scores of various formats but also supports the music format file such as MIDI including the music score information. The music score can only contain one open score or voice part and also can contain a plurality of open scores and music instruments. The music score can be displayed on the computer screen, one part of the music score or the open score also can be played freely so as to carry out the demonstration and teaching. (2) the action capturing unit: The action capturing unit can receive various input signals and convert the input signals to the performance information at least including the operation number as well as the performance actions such as force, timbre, pitch, after-touch and the like. The input device comprises computer peripheral equipment such as the computer keyboard, the touch screen, the camera and the like and also comprises the electronic music instrument devices connected by virtue of the USB interface, the MIDI and the like. The input signal must have good real-time property and shall contain more action information to enhance the music instrument performance experience and effect.

The performance ways of different music instruments are different, so different control actions are needed. Except for the playing force of fingers, control of tenuto, off beat, soft sound, hold tone, multi-chord and the like is also needed for the piano; the force, angle and position for plucking chords shall be controlled for playing the zither; moreover, control of string kneading, vibrato, portamento and the like is needed.

By adopting the electronic music instrument and music performance system, the electronic and digital music instruments can be used as external input devices to input the performance operation signal by virtue of the MIDI. The MIDI specification defines a great amount of control actions for playing music instruments. The action capturing unit redefines the significance of partial actions according to the requirements, and the convenience in operation is improved on the premise of ensuring the realization of the musical composition performance.

The performance on the touch screen is supported by the electronic music instrument and music performance system. The rhythm, force and timbre control information for operating the performance of the music instrument can be formed by virtue of the slide speed, length, shape, position and the like of fingers. The control of different performance voice parts is distinguished by dividing the screen into different areas.

The operation that the gesture action is analyzed by virtue of a real-time image of a camera is supported by the electronic music instrument and music performance system, so as to form the music instrument performance control information.

The simplest performance control can be realized by utilizing the computer keyboard. Since the key is only provided with information such as serial number, time and the like, the complete performance control information can be formed by adopting the performance information such as force, timbre, etc. contained in the music score; different keys of the computer keyboard can be defined to correspond to different voice parts, and different voice parts can be simultaneously played by multiple hands.

(3) the performance control unit: after the performance information generated by the action capturing unit, the notes which are at the closest to point in time and are not yet played and relevant performance information are extracted from the corresponding performance music score by the performance control unit according to the action serial number, and the extracted notes and relevant performance information are combined with the performance information generated by the action capturing unit to generate a complete music instrument performance control signal.

If the performance information generated by the action capturing unit is incomplete relative to the music instrument performance requirement, the electronic music instrument and music performance system extracts relevant information from the music score to supplement the performance information or adopts a preset default value. For example, in shortage of force control, the force information contained in the music score can be used in a default way; for the selected automatically-played open score, the performance control unit automatically forms the performance information of the voice part to realize the automatic performance of the open score. The automatic performance of the open score is equivalent to the automatic accompaniment. For example, for the piano music score, the operator can only play the melodic voice part, and the accompanying voice part is automatically played according to the real performance rhythm.

For a group of simultaneously-played notes of a single voice part, the software can be set to use one performance control action to play and also can be set in a way that each note of the same group is played independently by utilizing respective performance control action.

The electronic music instrument and music performance system needs to specify one performance open score as the reference open score to represent the real performance rhythm and speed of the entire musical composition. The performance control unit detects the performance rhythm of the reference open score to be used for controlling the automatic playing speed of the open score and for prompting and reminding the operator.

The complete music instrument performance control signal generated by the performance control unit can be directly transmitted to the digital music instrument unit and also can be transmitted to a third-party music instrument by virtue of the signal output unit.

(4) digital music instrument unit: the digital music instrument unit comprises one or more electronic music instruments realized by virtue of software. The digital music instrument unit can drive the electronic music instrument to generate music sound signals according to the music instrument performance control signal of the performance control unit, a music audio signal is generated by an audio device of the computer, for example, the music sound is transmitted by virtue of a loudspeaker or the audio signal is outputted by virtue of the audio interface.

At present, the electronic and digital music instruments are operated by virtue of MIDI interface specification, a lot of keyboard-type music instruments (such as pianos) can be well simulated, the control of a majority of performance actions and effects can be realized, however, the simulation of a bowstring, a plucked string, wind instruments, etc. is greatly limited. The digital music instrument unit included in the digital music instrument can adopt more complicated operation actions and signal definition relative to the MIDI specification to simulate the music instrument operation actions better and to create more complicated performance actions and ways.

(5) signal output unit: The connection of software and hardware is realized according to the interface specification of the electronic music instrument device, and the signal is transmitted to one or more connected electronic music instruments. The electronic music instrument and music performance system can be connected to external electronic and digital music instruments by virtue of the digital musical instrument interface (MIDI) and also can be connected to the digital music instrument device and software installed on the local machine.

According to the electronic music instrument and music performance method of each embodiment of the present invention, the complete music instrument performance action is generated collectively by combining the actions of the operator (player) and the music score information, specifically a simplified method for playing the music by utilizing the electronic music instrument according to the music score is provided, so that under the situation that the music sound pitch of the music instrument is not controlled, the music instrument and the music can be played by utilizing the electronic music instruments and by controlling the rhythm and/or electronic music instrument performance actions such as force, timbre, etc. Thus, the skills for playing the music instruments is greatly simplified, the difficulty in learning the music instrument performance is reduced and the convenience in playing the music instrument and music is improved.

According to the electronic music instrument and music performance method of each embodiment of the present invention, the electronic music instrument performance software including various functions such as the electronic music score management unit, the action capturing unit, the performance control unit and the digital music instrument unit (optional) can be installed on the computer or an intelligent terminal such as a smart phone, a tablet computer, etc.) with the software operating capacity and forms an electronic music instrument and music performance system (refer to FIG. 2) together with relevant input and output devices. During use, the operation signal is inputted by virtue of the keyboard, the touch screen or other device capable of generating action information, the operation signal is analyzed and processed to generate the music instrument performance control signal so as to control the digital music instrument unit to play the music, or the music instrument performance control signal is outputted to the third-party electronic music instrument device by virtue of the MIDI and other interfaces to realize the music performance. The third-party electronic music instrument device can be an external device, such as an electronic organ, an electrical piano, an electronic synthesizer and the like which are provided with MIDIs, and also can be the digital music software installed on the same computer such as the wavetable software synthesizer in Microsoft Windows system.

The electronic music instrument and music performance method of each embodiment has the following characteristics of:

(1) displaying the music score, the performance progress and the performance prompting information in a visualization manner, (2) detecting, prompting and evaluating the performance rhythm and speed; (3) automatically playing the non-played open score according to the real performance rhythm and speed; (4) being convenient to carry (5) being capable of networking.

Finally, it shall state that the preferable embodiments hereinabove are not used for limiting the present invention, although the present invention is illustrated in details according to said embodiments, the skilled in the prior art can alter the technical schemes of said embodiments or can perform equivalent substitution for partial technical characteristics of said embodiments. Any changes, equivalent substitutions, improvements and the like made within the spirit and principle of the present invention shall be incorporated in the protection scope of the present invention.

The invention claimed is:

1. A method for performing an electronic music instrument, comprising:

a, selecting a music score to be played in an electronic music score management unit;

b, selecting at least one performance voice part and a needed automatically-played voice part from the performance control unit; selecting an input device and performance music instrument corresponding to each performance voice part; selecting a performance music instrument corresponding to the automatically-played voice part; selecting to output to one or more of a digital music instrument unit and a signal output unit; selecting one performance voice part as a reference voice part; and c, starting the performance, then receiving an operation signal from the input device, converting the operation signal into a performance control signal, sending the performance control signal to the digital music instrument unit to carry out the corresponding performance actions under the control of the performance control unit, or sending the performance control signal to the signal output unit.

2. The method according to claim 1, wherein in the step b, the performance control signal is sent to the digital musical instrument unit under the control of the performance control unit, so that the digital music instrument unit carries out relevant performance actions or the performance control signal is sent to the signal output unit, specifically comprising the following steps:

b1, receiving the operation signal inputted by the control input device by virtue of an action capturing unit, and converting the operation signal to a music instrument performance action signal;

b2, generating a performance control signal by virtue of the performance control unit on the basis of the performance action signal and in conjunction with the music score information;

b3, detecting the reference open score playing speed on the basis of the performance control signal, and generating a performance control signal of the automatically-played voice part according to the benchmark playing speed and the music score information; and b4, sending the performance control information to the digital music instrument unit to carry out the performance, or ding to the signal output unit to control a corresponding electronic music instrument to carry out the performance.

3. The method according to claim 2, wherein in the step b3, the operation for controlling the automatically-played voice parts according to the reference playing speed specifically comprises the following steps:

determining a playing point in time of each note or each group of notes of each automatically-played voice part according to the reference playing speed, wherein the reference playing speed comprises the music rhythm; and extracting corresponding performance information from the music score at every time of and after the performance time of each reference voice part and when the playing point in time of the automatically-played voice part is reached to generate the performance control signal.

4. The method according to claim 1, wherein the electronic music instrument management unit comprises:

a music score input module which is used by a user to input music score data file; and a music score storage module which is used for storing the music score data file inputted from the music score input module to form a user music library which is supplied for the performance control unit to call.

5. The method according to claim 1, wherein the input device comprises one or more of a computer keyboard, a touch screen, a camera and a communication interface connected with external devices, which are respectively connected to the electronic music instrument performance device; and wherein the input device also comprises a communication interface connected with the input device, wherein said communication interface comprises one or more of an MIDI, a Bluetooth interface, and a USB interface.

6. The method according to claim 1, wherein the output device comprises an audio device which is connected with the digital music instrument unit and used for receiving an audio signal outputted by the digital music instrument unit as well as one or more of an electronic music instrument, a digital music instrument, a local digital music instrument and a synthesizer, which are respectively connected with the signal output unit and used for receiving the performance signal outputted by the signal output unit.

7. The method according to claim 1, wherein the performance control unit comprises:

a music information extraction module which is used for extracting one note or a group of notes which are to be played and are the closest to the present time point as well as relevant performance information from a performance open score corresponding to the input device and action;

a second signal generating module which is used for generating the performance information acquired by a first signal conversion module and the current music score performance information extracted by the music score information extraction module into a complete music instrument performance control signal and outputting the complete music instrument performance control signal respectively to one or more of the digital music instrument unit and signal output unit;

a performance rhythm detection module which is used for detecting the reference open score playing speed which is adopted as the reference playing speed or rhythm on the basis of the music instrument performance control signal; and an automatic performance unit which is used for controlling the automatic performance of the non-played voice part according to the reference playing speed so as to realize the automatic accompaniment and ensemble.

8. The method according to claim 1, wherein the electronic music instrument performance device comprises an action capturing unit and a performance control unit, which are sequentially connected with the operation control input device as well as an electronic music score management unit, a digital music instrument unit and a signal output unit, which are respectively connected with the performance control unit; and wherein the digital music instrument unit and the signal output unit are respectively connected to the output device.

9. The method according to claim 8, wherein the action capturing unit, comprising:

a signal receiving module which is used for receiving the operation signal generated by the operation control input device; and a first signal conversion module which is used for converting the operation signal received by the signal receiving module to performance information at least including an operation number; the performance information converted by the input device with various operation action types also includes one or more of performance actions selected from a group consisting of force, timbre, pitch and after-touch.

10. The method according to claim 2, wherein the electronic music instrument management unit comprises:

a music score input module which is used by a user to input music score data file; and a music score storage module which is used for storing the music score data file inputted from the music score input module to form a user music library which is supplied for the performance control unit to call.

11. The method according to claim 3, wherein the electronic music instrument management unit comprises:

a music score input module which is used by a user to input music score data file; and a music score storage module which is used for storing the music score data file inputted from the music score input module to form a user music library which is supplied for the performance control unit to call.

12. The method according to claim 2, wherein the input device comprises one or more of a computer keyboard, a touch screen, a camera and a communication interface connected with external devices, which are respectively connected to the electronic music instrument performance device; and wherein the input device also comprises a communication interface connected with the input device, wherein said communication interface comprises one or more of an MIDI, a Bluetooth interface, and a USB interface.

13. The method according to claim 3, wherein the input device comprises one or more of a computer keyboard, a touch screen, a camera and a communication interface connected with external devices, which are respectively connected to the electronic music instrument performance device; and wherein the input device also comprises a communication interface connected with the input device, wherein said communication interface comprises one or more of an MIDI, a Bluetooth interface, and a USB interface.

14. The method according to claim 2, wherein the output device comprises an audio device which is connected with the digital music instrument unit and used for receiving an audio signal outputted by the digital music instrument unit as well as one or more of an electronic music instrument, a digital music instrument, and a local digital music instrument and a synthesizer, which are respectively connected with the signal output unit and used for receiving the performance signal outputted by the signal output unit.

15. The method according to claim 3, wherein the output device comprises an audio device which is connected with the digital music instrument unit and used for receiving an audio signal outputted by the digital music instrument unit as well as one or more of an electronic music instrument, a digital music instrument, and a local digital music instrument and a synthesizer, which are respectively connected with the signal output unit and used for receiving the performance signal outputted by the signal output unit.

16. The method according to claim 2, wherein the performance control unit comprises:

a music information extraction module which is used for extracting one note or a group of notes which are at the closest pot in time and are not played as well as relevant performance information from a performance open score corresponding to the input device and action;

a second signal generating module which is used for generating the performance information acquired by a first signal conversion module and the current music score performance information extracted by the music score information extraction module into a complete music instrument performance control signal and outputting the complete music instrument performance control signal respectively to one or more of the digital music instrument unit and signal output unit;

a performance rhythm detection module which is used for detecting the reference open score playing speed which is adopted as the reference playing speed or rhythm on the basis of the music instrument performance control signal; and an automatic performance unit which is used for controlling the automatic performance of the non-played voice part according to the reference playing speed so as to realize the automatic accompaniment and ensemble.

17. The method according to claim 3, wherein the performance control unit comprises:

a music information extraction module which is used for extracting one note or a group of notes which are at the closest point in time and are not played as well as relevant performance information from a performance open score corresponding to the input device and action;

a second signal generating module which is used for generating the performance information acquired by a first signal conversion module and the current music score performance information extracted by the music score information extraction module into a complete music instrument performance control signal and outputting the complete music instrument performance control signal respectively to the digital music instrument unit and/or signal output unit;

a performance rhythm detection module which is used for detecting the reference open score playing speed which is adopted as the reference playing speed or rhythm on the basis of the music instrument performance control signal; and an automatic performance unit which is used for controlling the automatic performance of the non-played voice part according to the reference playing speed so as to realize the automatic accompaniment and ensemble.

18. The method according to claim 2, wherein the electronic music instrument performance device comprises an action capturing unit and a performance control unit, which are sequentially connected with the operation control input device as well as an electronic music score management unit, and a digital music instrument unit and a signal output unit, which are respectively connected with the performance control unit;

wherein the digital music instrument unit and the signal output unit are respectively connected to the output device.

19. The method according to claim 3, wherein the electronic music instrument performance device comprises an action capturing unit and a performance control unit, which are sequentially connected with the operation control input device as well as an electronic music score management unit, and a digital music instrument unit and a signal output unit, which are respectively connected with the performance control unit;

wherein the digital music instrument unit and the signal output unit are respectively connected to the output device.

* * * * *